United States Patent [19]

Scarabino et al.

[11] Patent Number: 4,687,193

[45] Date of Patent: Aug. 18, 1987

[54] DUAL FORCE JOGGER/STACKER FOR CUT SHEET ITEMS

[75] Inventors: Mario J. Scarabino; Emmett B. Peter; Gerald F. Rettner, all of Orlando, Fla.

[73] Assignee: Unisys Corporation (formerly Burroughs), Detroit, Mich.

[21] Appl. No.: 848,335

[22] Filed: Apr. 3, 1986

Related U.S. Application Data

[63] Continuation of Ser. No. 723,381, Apr. 15, 1985, abandoned.

[51] Int. Cl.[4] ..... B65H 29/20

[52] U.S. Cl. ..... 271/184; 271/217; 271/314; 414/54

[58] Field of Search ..... 271/314, 279, 285, 286, 271/299, 184, 225, 207; 414/54, 62

[56] References Cited

U.S. PATENT DOCUMENTS 3,669,447 6/1972 Turner ..... 271/120 X
4,017,066 4/1977 Lasher ..... 271/314

*Primary Examiner*—Richard A. Schacher
*Attorney, Agent, or Firm*—Carl Fissell, Jr.; Edmund M. Chung; Kevin R. Peterson

[57] ABSTRACT

Apparatus for precisely edge aligning and offsetting or jogging stacks of sheet items wherein two oppositely disposed alternately actuated continuously rotating paddle members each produce driving forces at right angles to one another effective to force each item first in one direction and then in another direction at right angles thereto such that the sheet items operational with respect to any paddle are caused to be stacked in offset alternating piles against confronting opposite walls of a stacker frame member.

8 Claims, 12 Drawing Figures

FIG. 2.
FIG. 2A.
0° POSITION
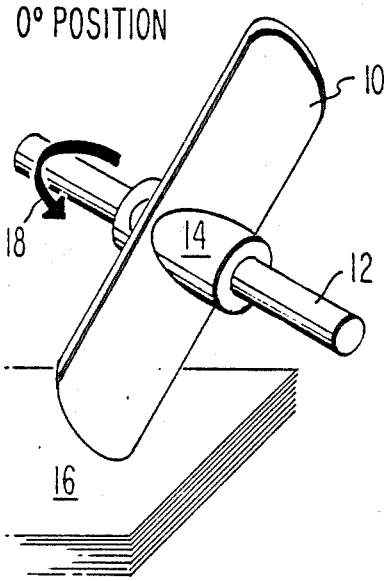
FIG. 2C.
180° POSITION
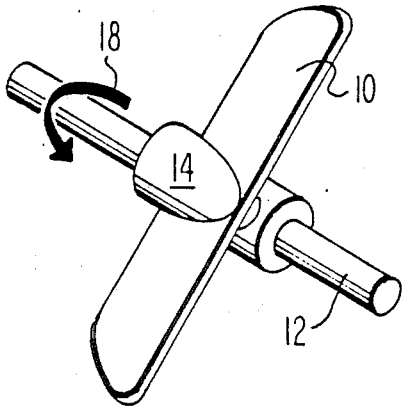
FIG. 2B.
90° POSITION
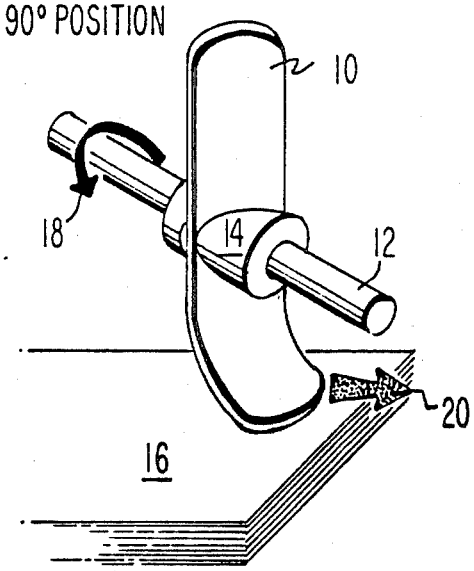
FIG. 2D.
270° POSITION
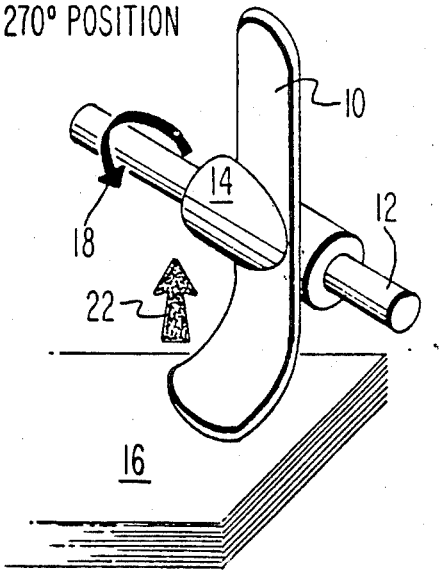
FUNCTIONAL OPERATION OF PADDLE.

| FIG.3A. |
| --- |
| FIG.3B. |

DUAL FORCE JOGGER/STACKER FOR CUT SHEET ITEMS

This is a continuation of co-pending application Ser. No. 723,381 filed on 4/15/85, now abandoned.

BACKGROUND OF THE INVENTION

1. Field of the Invention

The present invention relates to paper handling apparatus and more particularly to means for offsetting ordered stacks of similarly sized paper sheets or similar documents.

2. Description of the Prior Art

A variety of different approaches to the requirement for displacing alternate documents or groups of documents as the latter are stacked in a receptacle have included, for example, "toggling" the receptacle to offset one or more documents from succeeding incoming documents; pneumatically actuating lifter shoes for offsetting alternately stacked documents; tray shifting means for laterally translating the last fed document stacked away from the next incoming document; angled feeder rolls; and so on.

Although each of these mechanisms has certain utility, all are expensive to fabricate, overly complex in construction and require more than a modest amount of maintenance.

SUMMARY OF THE INVENTION

The present invention solves the foregoing and other associated problems of offset document stacking by providing alternately actuated rotatable paddle wheel like members arranged to intermittently contact the surface of the document so as to force the document to move in alternate directions relative to the document stacking flow effective to offset one document or stack of documents with respect to another document or stack of documents in a continuous uninterrupted flow of documents.

More specifically, the present invention provides means mounting two, oppositely disposed, vertically oriented, flexible, flat paddles carried at the outboard ends of individual flexible shaft members. The paddles are arranged in angled, confronting relationship above the document tray.

A tray elevating mechanism includes a vertical post or shaft disposed beneath and attached to the copier/-printer base. Oppositely disposed pulleys carried by an angled support secured to the tray bottom act to guide the tray vertically up and down along a screw assembly relative to the paddle assembly disposed thereabove. Drawer slides secured to the opposite parallel edges of the tray permit the latter to slide forwardly and rearwardly normal to the direction of movement of the documents.

In order to ensure that the sheet items lie flat within this receiving tray a solenoid activated mechanism is provided to tap down the trailing edge of each item effectively forcing the item out of the path of the next incoming sheet item.

A clutch and differential control means interconnects the two paddles by way of individual flexible drive links. Electronic control is provided by the printer/-copier software effective to cause the paddles to operate on command so as to selectively stack individual or multiple documents with an offset therebetween.

Strategically placed electrical interlock switches monitor and control all operations of the stacking apparatus including the tray and vertical drive mechanism.

BRIEF DESCRIPTION OF THE DRAWINGS

FIG. 2A–2D inclusive are highly schematic views (not to scale) illustrating the functional operation of the paddle wheels of the present invention relative to the item stack;

DESCRIPTION OF THE PREFERRED EMBODIMENT

Figure 1:
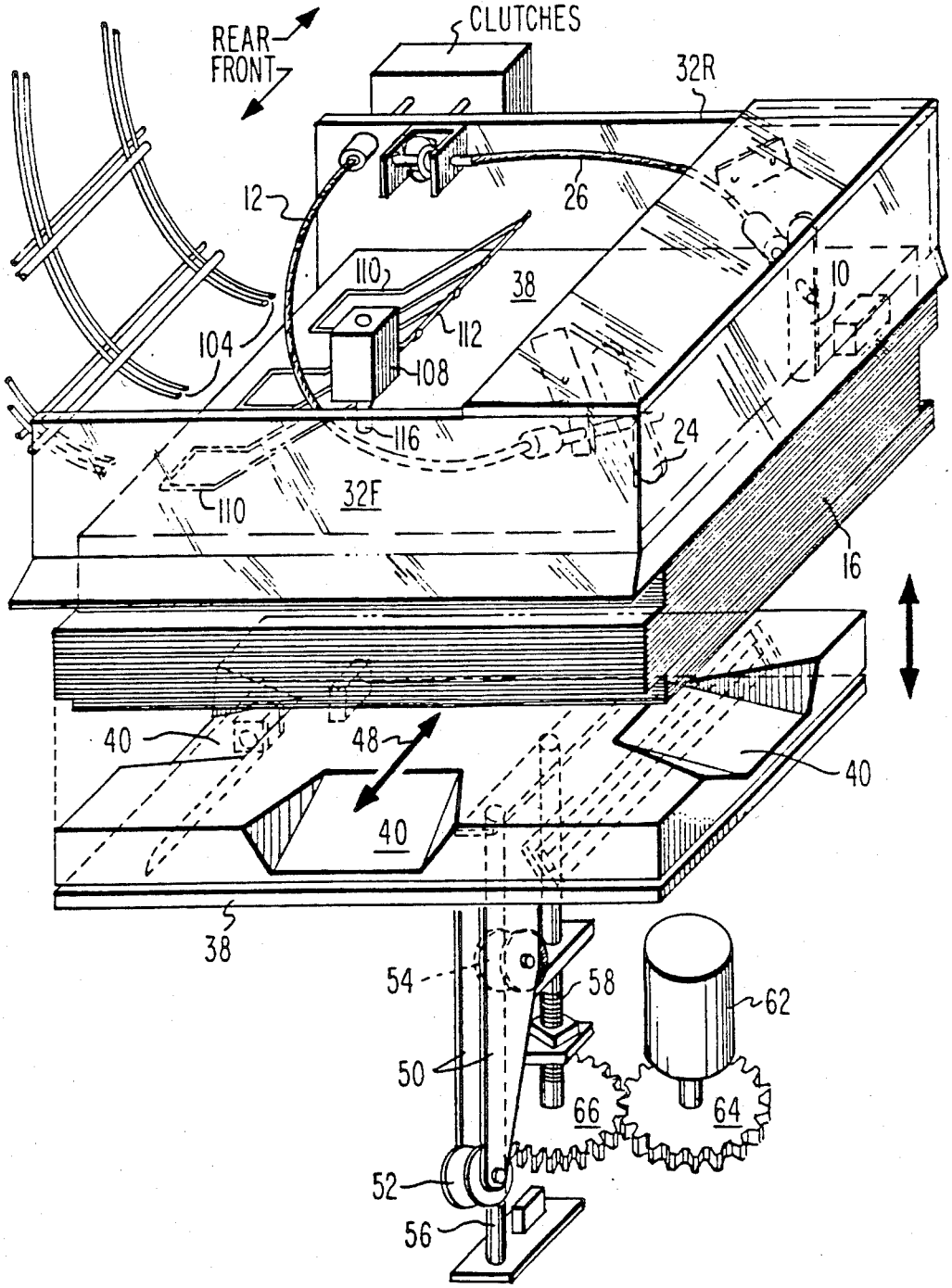
FIG. 1 is a conceptual isometric illustration (not to scale) of apparatus embodying the present invention.

It has been determined experimently that a rotatable resilient member disposed and moved in contact with sheet item material can cause the material to move in the direction of the applied rotative force.

However, in order to move sheet items in two different directions multiple rotatable members have been employed including means to change the direction of the applied force or forces. Multiple force applying mechanisms such as rotating wheels, oscillating links and reciprocating levers have been found to be expensive to fabricate, costly to maintain and as often as not are subject to breakdown and item jams. The present invention avoids and/or solves these and other similar problems in a new, novel and unobvious manner as hereinafter set forth.

As illustrated in FIGS. 2A–2D inclusive a single, elongated, rectangular section of an elastomer of a given thickness and durameter (hardness) forming a paddle member 10 is mounted through its center point to a rotatable shaft 12 at 45° to the shaft. Member 10 is rotated by the shaft 12 such that the outside edges of member 10 are perpendicular to the axis of shaft 12.

The elastometer paddle 10 which is secured to the forward rigid end of flexible drive shaft 12 by means of mounting hub 14, comprises a relatively thin (in cross section) flexible (bendable) strip, on the order of 2.75 inches long, by $\frac{5}{8}$ inches wide and $\frac{1}{8}$ inches thick. FIGS. 2A–2D illustrate the basic positions of member 10 during rotation of drive shaft 12 relative to incoming sheet items 16 against which member 10 is rotated.

When shaft 12 is rotated, the paddle 10 contacts the sheet item 16 two times per revolution. Referring to FIGS. 2A–2D at 0° and 180° respectively, the paddle 10 is in a plane parallel to and above the items 16 while at 90° and 270°, respectively, the paddle is in contact with the surface of the items 16 and produces a force with each contact. Each time the elastomer 10 contacts a sheet item 16, it begins to bend along the plane of least resistance (i.e. the width).

The edge of the elastomer 10 in contact with the material 16 begins to slide at 45° to the axis of rotation of shaft 12 as the paddle rotates. As member 10 slides, it produces frictional forces required to move the items 16. This force is also at 45° to the axis of rotation of shaft 12 and the second contact will product a force at 90° to the first force.

Starting at position 0°, FIG. 2A, the shaft 12 is rotated in the direction of arrow 18. In the 90° position, FIG. 2B, member 10 is exerting a force forwardly (arrow 20) with respect to the sheet items 16. From 90° to 180° position, FIG. 2C, the member 10 is out of contact with items 16. At the 270° position of shaft 12, FIG. 2D, elastomer member 10 now produces a force (arrow 22) at right angles to the force at 90° forcing the sheet item backwardly in the direction of arrow 20.

As earlied noted herein, the present invention is directed to the technique of offset stacking of sheet items, i.e. item jogging, so that, for example, multiple copies of page 1 of a manuscript can be offset with respect to multiple copies of page 2 of the same manuscript and so on with each subsequent (see FIG. 1) page or, stacks of pages may be offset relative to other stacks. This enables the operator to collate the copies into individual manuscripts easily and quickly without first sorting the stacked pages into single "page" piles or groups.

To accomplish this result, the structural arrangement of FIGS. 1–4B is provided. As illustrated, the invention incorporates two rotatable paddles 10 and 24, FIGS. 1 and 1A, each of which is secured for rotation to the respective forward end of individual, flexible drive shafts 12 and 26. Mounting brackets 28—28 support paddles 10 and 24 to the top or roof 30 of a rectangular frame 32. Shafts 12 and 26 are arranged relative to their respective mounting support brackets 28—28 such that each paddle 10 and 24 is oriented at 45° relative to the adjacent edge of the sheet item. See FIGS. 1 and 1A. Drive shafts 12 and 26 terminate at their inboard rear ends in support fixtures secured to the rear inboard wall of the copy apparatus. Coupling gears (not otherwise shown in detail) in mesh with a constantly rotating drive gear driven from the main drive of the printer/copier, apply rotative motion to shafts 12 and 26. Individual wire wrap clutches (not shown) actuated in response to signals from the copier software transmit rotative torque to a respective paddle 10 or 24.

Accurate registration and edge alignment of the sheet items 16 is accomplished by means of oppositely disposed radial protuberances 34F–34R located at the inboard (rightward in FIG. 1A) end of the stacking frame 32 in combination with the parallel walls 32F (front) and 32R (rear). In this connection, it is noted that assuming the rear paddle 10 is operating, the incoming sheet item will be driven first forwardly, then rearwardly back against the rear wall 32R so as to register against both the inboard end (right in FIG. 1) and the rear wall 32R. Conversely, if front paddle 24 is operating, sheet item 16 will be driven forwardly then frontwardly against the front wall 32F so as to register against both the inboard end 34R (right in FIG. 1A) and front wall 32F.

For ease of operator access in unloading the stacked/jogged sheet items 16, a sheet item tray 38 is adapted to be moved both into and out of the base printer/copier assembly as well as vertically up and down relative to the stacker/jogger frame 32. Item tray 38 is a substantially flat member provided with multiple angled access depressions 40, see FIGS. 1 and 1A, permitting operator hand access to the stacked sheet items 16.

Figures 3, 3A:
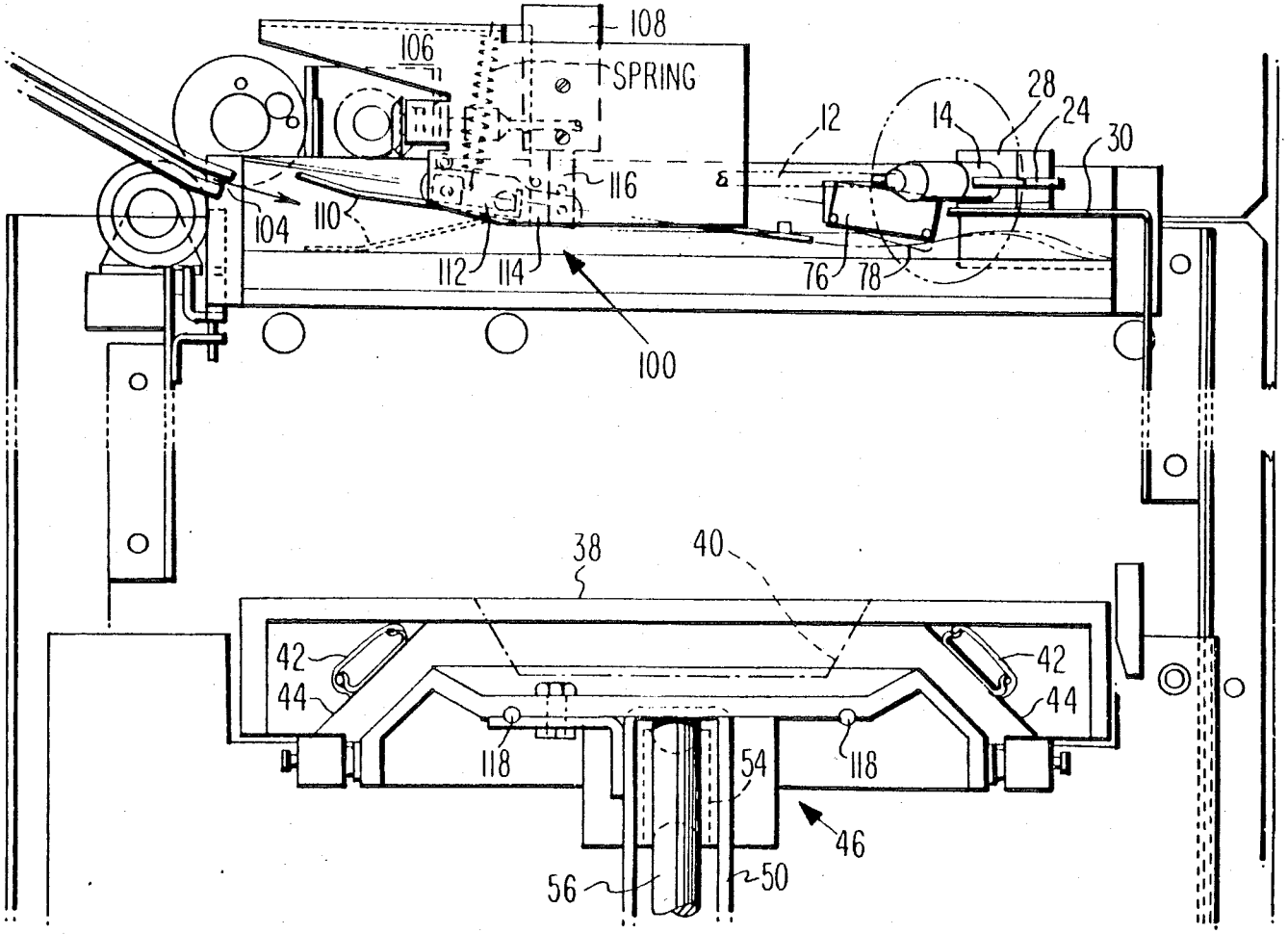
FIG. 3 is a schematic chart illustrating the positioning of the views of FIGS. 3A and 3B.
FIGS. 3A and 3B together form a front elevational view of the apparatus of FIG. 1.

Attached to tray 38, FIG. 3, are the upper halves of right and left drawer slides 42 while the lower halves of slides 42 are attached to the slanted or angled sides 44 of a tray lift assembly 46. The two slides 42—42 secure the lift assembly to tray 38 permitting the tray to be withdrawn (arrow 48, FIG. 1) from the printer/copier for item stack removal. The 90° angular displacement between the two drawer slides also minimizes the "play" in all directions making a very stable arrangement.

Figure 3B:
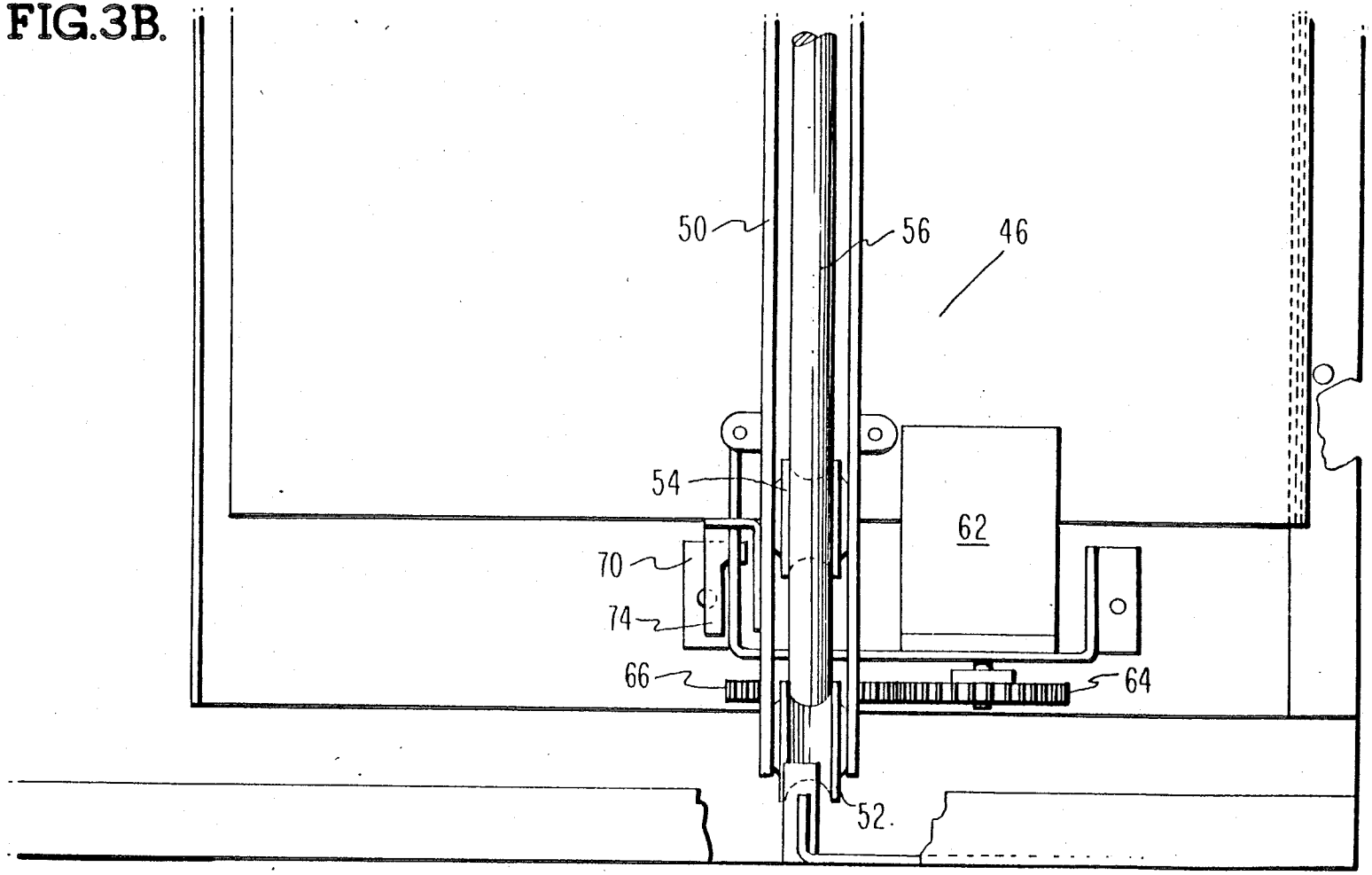
Figure 4:
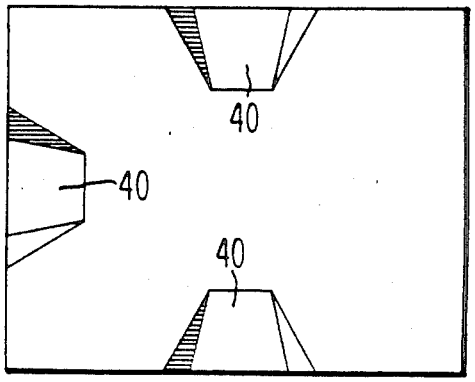
FIG. 4 is a top plan view of the item tray.

Lift assembly 46, FIGS. 3A and 3B, includes an angularly, disposed, irregularly shaped support bracket 50 provided, with a front and rear rotatable pulley wheel assembly 52 and 54, respectively. A vertically disposed shaft 56 intermediate pulleys 52 and 54 (FIGS. 1, 3B and 4B) permit the tray 38 to move up and down as the incoming items 16 fill up the tray.

Figure 5:
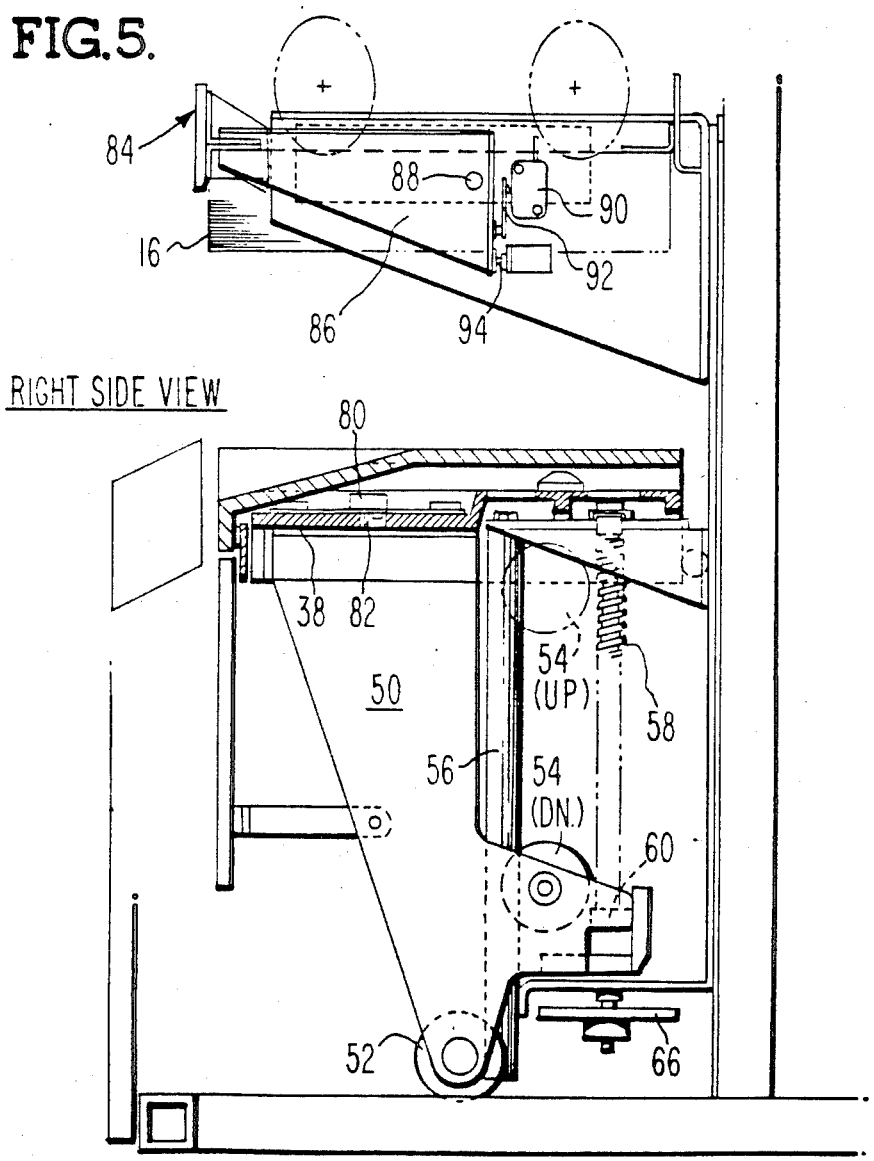
FIG. 5 is a right side elevational view of the apparatus of FIG. 1.
Figure 6:
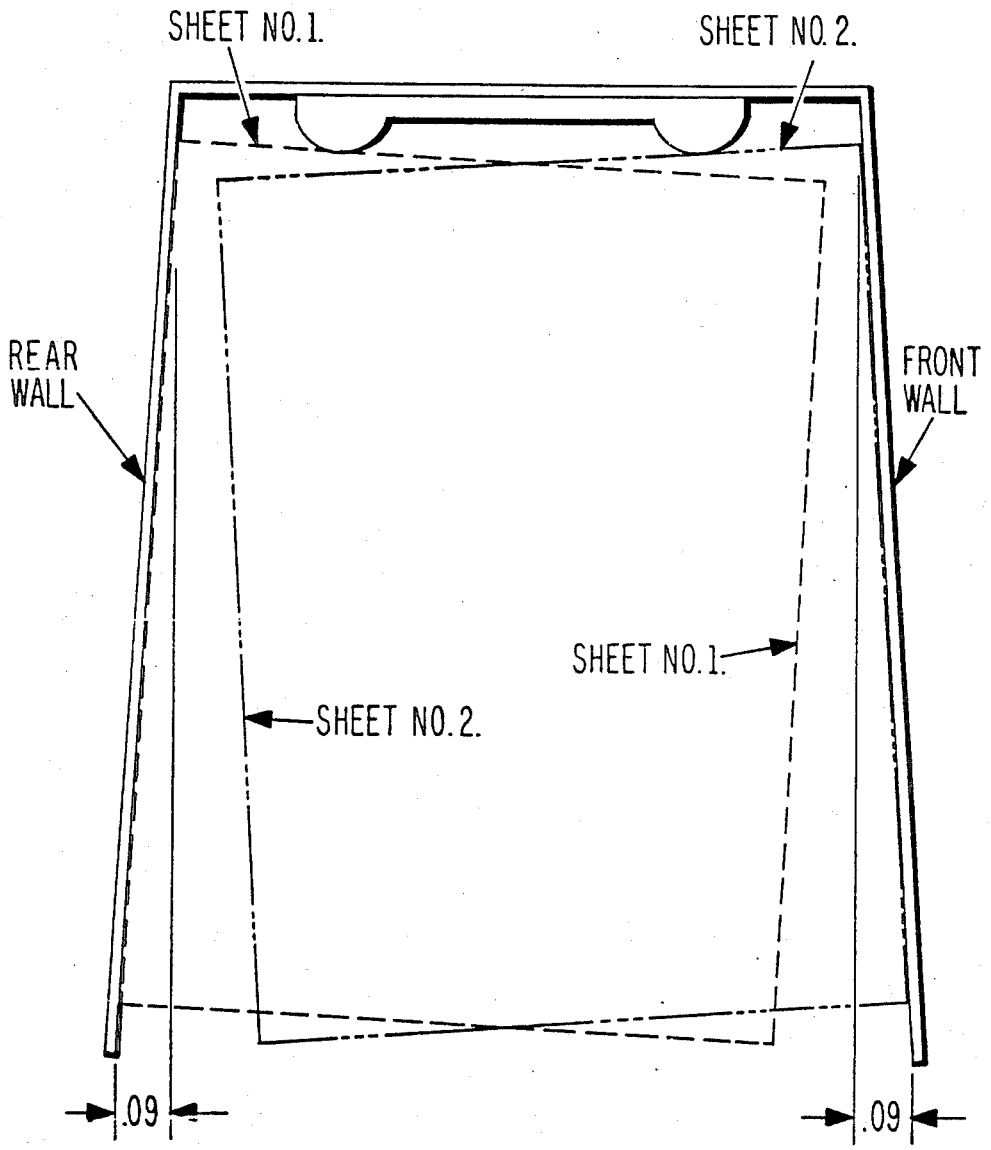
FIG. 6 is a top plan view to show the very slight angularity of the stacker walls of the invention.

Incremental vertical movement or travel of item tray 38 along shaft 56 is provided by means of a helically threaded screw member 58, FIGS. 1 and 5, vertically disposed adjacent and parallel to shaft 56 and support bracket 50. A threaded nut member 60 is fixed to bracket 50 and captivated on screw member 58. A high torque drive motor 62, FIGS. 1 and 3B, rotating drive pulley 64 engaging driven pulley 66 rotates screw member 58.

Rotation of helical member 58 within captivated nut 60 on bracket 50 causes the lift assembly 46 to raise or lower the tray 38 depending upon the direction of rotation of drive motor 62.

Oppositely disposed travel limiting devices are employed with the sheet item tray 38 and operably associated tray lift assembly 46. A lower limit switch 70 is secured to the mounting bracket 72 supporting drive motor 62. Downward movement of tray 38 ultimately causes the tray to engage the actuator 74 which shuts off power to drive motor 62 after a 1 inch additional downward tray movement, as will be explained shortly herein.

An upper travel limit switch 76, FIG. 3A, is disposed within the frame 32 with the actuator 78 depending into the upward path of movement of tray 38. Switch 76 performs a dual function. It acts as a paper height sensing switch on the one hand and as a vertical tray movement limit switch on the other hand.

In order to avoid any possibility of operator accident with respect to the aforedescribed movable mechanism, a drawer slide switch 80, FIG. 5, is provided. The actuator 82 is engageable with the underside of the tray 38 such that outward movement of the tray 38 immediately stops the printer/copier including the lift assembly 46 by opening the switch contacts.

The clutch and control arrangement (not shown) is such that, for example, the operator can select which of the two paddles 10 or 24 are to be actuated, i.e. first one than the other, etc., so as to provide the desired number of offset, jogged copies.

Sheet items 16 are, by nature, relatively flimsy, easily bent, torn, dogeared and otherwise mutilated and distorted. In addition, paper edges in a stack are not commonly, ordinarily at a precise 90° corner alignment with respect to each other. It is therefore a real problem to assure in offset stacking or jogging, that each group of pages of items is precisely offset and edge aligned with respect to the next similarly selected group of items.

Paper media, specifically, cut-sheet paper can have corners that are not 90°. Optimum registration of paper occurs with one edge of the sheet in plane contact (line contact) (front and rear) and a second edge perpendicular to the first in point contact (right).

By angling the front and rear walls, it is possible to optimumly locate the point contact position to achieve consistent stack quality. With the angle and point contact set, the system is capable of registering sheets consistently, regardless of the sheet corner angle, to either the front or rear jogged positions.

Figure 1A:
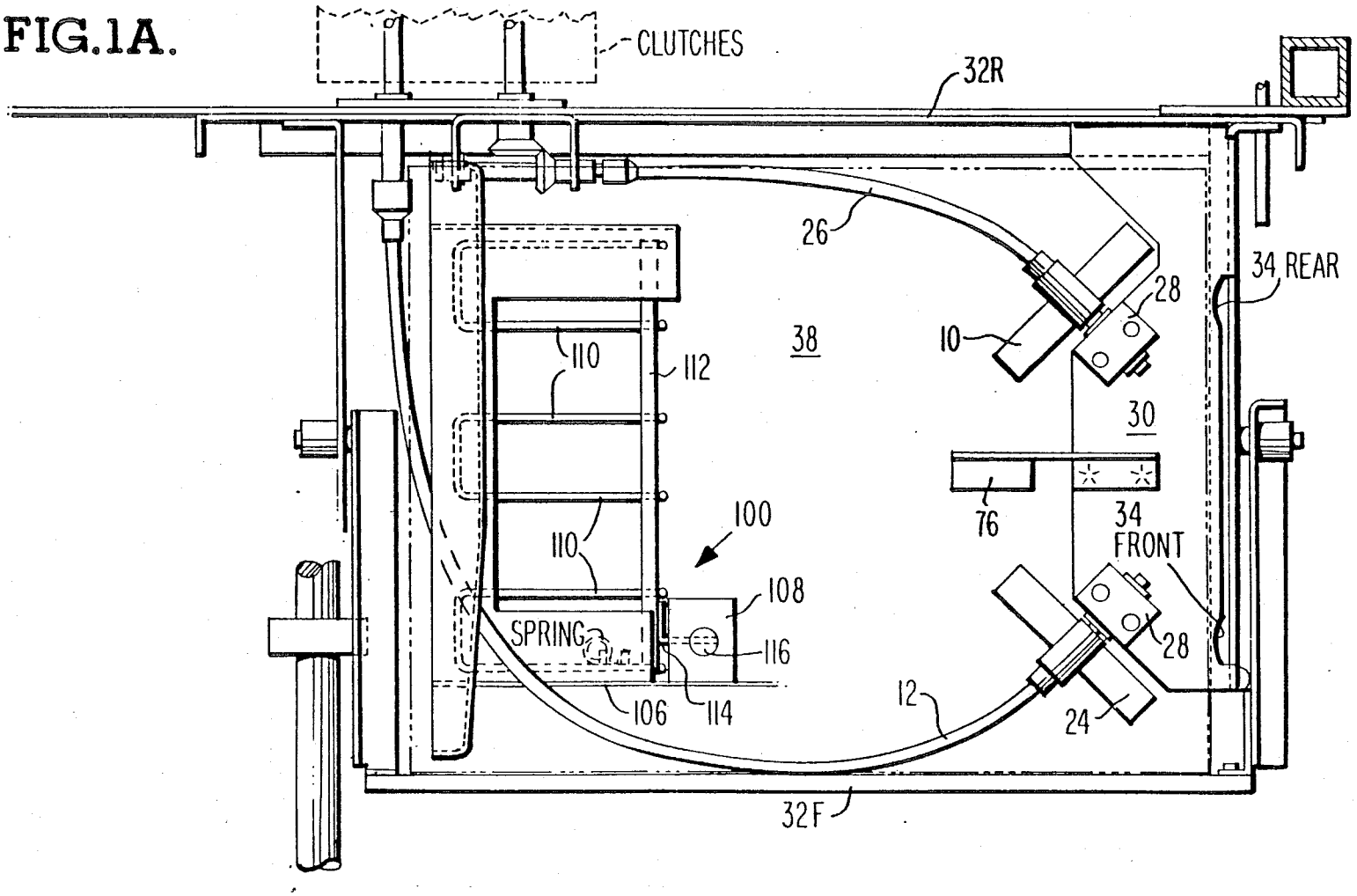
FIG. 1A is a top plan view of the apparatus of FIG. 1 illustrating the various drive mechanisms of the invention.

In light of the aforesaid requirement for precise alignment, the present invention incorporates as an element of the combination a pair of rigid, radially curved protuberances 34F–34R, FIG. 1A, disposed at the righthand end of frame 32. Members 34F–34R are nominally situated intermediate the opposite side walls 32F and 32R as seen in FIG. 1A. This construction assures that if the inboard paddle 10 is operating, the sheet items 16 will be forced against the inboard wall and the inboard member 34R. While if the outboard paddle 24 is operating, the sheet items 16 will be forced against the outboard wall and outboard member 34F. This structural arrangement automatically functions to edge align all the items of any stack of items.

The assembly identified, FIG. 5, as front shield 84 and support brackets 86 is characterized as a front paper guide and safety switch apparatus and could be fabricated from transparent material, e.g. plexiglass, polycarbonate, etc. permitting visual monitoring of the paper height on tray 38.

In this connection it is noted that as the paper tray is raised during operation of the apparatus the stack of paper ultimately reaches a point in its vertical, upward travel in which the top sheets are slightly above the lower edge of member 84. At this point, should the operator attempt to remove the paper stack from the tray top before stopping the machine operation, the action of raising the front shield member 84 will cause the side brackets 86 to pivot about pivot 88 actuating safety power cut-off switch 90 by permitting the switch actuator 92 to open the switch contacts. This action interrupts power to the main drive which stops the movement of the paper. Switch closure adjustment means 94 provides a stop for the arcuate travel of brackets 86 permitting the power cut-off to occur earlier or later in point of time as desired to avoid operator interference or accident.

Referring to FIGS. 1A and 3A there is shown a sheet item trailing edge depresser (trail tapper assembly) 100 which is disposed rightwardly of the sheet item exit throat 104, Fig, 3A. Assembly 100 comprises a mounting bracket 106 supporting an actuating solenoid 108. A plurality of presser fingers 110, e.g. thin but fairly rigid, elongated wire loops, are secured at their inboard ends to a movable cross shaft 112 pivotally secured to one end of a rocker link 114. The opposite end of rocker link 114 is pivoted to the plunger 116 of solenoid 108. The opposite end of each wire finger loop 110 is slightly, upwardly, angularly, bent out of the horizontal plane, as seen in FIG. 3A, so as to permit the wire form members 110 to make a substantially flat contact with the surface of the sheet items as each sheet is ejected into the picker area from the feed throat 104. This action serves to prepare the stack for the next sheet by removing excess air from between the sheets and forcing the previous sheet down below the entry paper path.

As earlier mentioned herein, the tray 38 is horizontally movable along drawer slides 42, FIG. 3B. A handle 118 (only the attachment ends being shown in cross section) FIG. 3A, is secured to the outwardly facing edge of tray 38 for moving the filled tray outwardly for ease of operator access. The drawer slide or tray removal safety switch 80, FIG. 5 (bottom), has its actuator 82 arranged to close the switch contacts removing power to the machine once the drawer or tray 38 is moved to the outward open position. This prevents accidental engagement of operator hands or fingers with the moving parts of the apparatus.

What is claimed is:

1. High speed document stacking apparatus for offsetting or jogging individual stacks or piles of sheet items comprising:

a sheet item receiving tray, means to move said item receiving tray vertically in opposite directions to accommodate the incoming documents as the tray fills with documents, oppositely disposed individual independently operable, rotatable means arranged to contact and move each sheet item fed thereto, means rigidly supporting said rotatable means above said item receiving tray in confronting, offset relation in the same plane, said supporting means including individual drive means for activating said rotatable means and means for registering at least two opposite edges of each sheet item at the termination of the inflow movement of said item, each of said rotatable means being effective when selectively energized to apply orthogonal forces to each sheet item so as to move said item in two opposite directions away from said rotatable means and toward said registering means so that the said items are selectively stacked in offset piles, and control means for selectively energizing each one of said rotatable means.

2. The combination according to claim 1 wherein said tray moving means comprises a vertically fixed but rotatable helical member and means captive on said helical member operably interconnecting said tray and said helical member and drive means for rotating said helical member within said captive means so as to move said tray along said helical member vertically up and down on demand.

3. The combination according to claim 1 wherein said rotatable means comprises two independently driven, vertically fixed, multi-blade, flexible members arranged at opposite sides of said tray at the same elevation so as to rotate at an angle relative to each other.

4. The combination according to claim 1 further including individual, flexible drive means coupled to each rotatable member and electro magnetic means for controlling the energization of said drive means.

5. The combination according to claim 1 wherein each of said rotatable means comprises an elastomeric paddle and wherein each paddle is set at 45° relative to the adjacent edge of the incoming sheet item and to the axis of rotation of said drive means.

6. The combination according to claim 1 wherein said supporting means for said rotatable means comprises an open rectangular frame member having non-parallel side walls and a front wall including a radial protuberance cooperating with said side walls so as to register said sheet items.

7. The combination according to claim 1 further including sheet item trailing edge depressor means having one or more members arranged parallel to the sheet item path of movement for pressing each sheet item downwardly as the trailing edge of each item enters the item receiving tray.

8. The combination according to claim 7 including electromagnetic signal actuated means operably connected to said trailing edge depresser means for automatically moving the trailing edge of each incoming sheet item downwardly out of the path of the next incoming sheet item.

* * * * *